United States Patent [19]

Costello

[11] 4,088,202

[45] May 9, 1978

[54] SCAFFOLDING CART

[76] Inventor: Clifford T. Costello, 9654 S. Nogales Hwy., Tucson, Ariz. 85706

[21] Appl. No.: 717,473

[22] Filed: Aug. 25, 1976

[51] Int. Cl.[2] ..... E04G 1/20; B60K 7/00; E04G 1/24

[52] U.S. Cl. ..... 182/13; 182/16; 182/119; 182/148; 180/52; 180/65 F; 180/79; 180/2 R

[58] Field of Search ..... 182/119, 118, 113, 16, 182/13, 141, 148, 63; 5/11, 93 R; 180/2, 52, 65 F, 79

[56] References Cited

U.S. PATENT DOCUMENTS

| | | | |
|---|---|---|---|
| 2,242,307 | 5/1941 | Kroll | 5/11 |
| 2,297,963 | 10/1942 | Kroll | 5/11 |
| 2,562,053 | 7/1951 | Mars | 5/11 |
| 2,573,575 | 10/1951 | Keroson | 182/16 |
| 2,989,139 | 6/1961 | Pantek | 182/16 |
| 3,180,450 | 4/1965 | Crager | 182/16 |
| 3,212,605 | 10/1965 | Dickerson | 182/152 |
| 3,865,203 | 2/1975 | Hibma | 182/16 |

FOREIGN PATENT DOCUMENTS

| | | | |
|---|---|---|---|
| 84,097 | 10/1964 | France | 182/16 |
| 897,958 | 6/1962 | United Kingdom | 182/16 |

*Primary Examiner*—Reinaldo P. Machado
*Attorney, Agent, or Firm*—Cahill, Sutton & Thomas

[57] ABSTRACT

An electrically powered steerable scaffolding cart having a vertically positionable platform and handrails transports and supports a workman while he performs overhead work.

15 Claims, 5 Drawing Figures

SCAFFOLDING CART

The present invention relates to scaffolding carts and, more particularly, to scaffolding carts which are horizontally mobile and vertically adjustable without the aid of a helper.

During construction of buildings, a substantial amount of overhead work must be performed. Such work is particularly related to the installation and operation of electrical lights and wiring; moreover, duct work and fittings relating to heating and cooling systems must often be installed from a position beneath the respective ceilings. Because ceilings are at least at a height of eight feet, and often much higher, platforms of some type must be employed by the workmen. These platforms are generally referred to as scaffolding carts.

Scaffolding carts of various types have been employed for a number of years. U.S. Pat. No. 2,506,860, describes a traveling scaffold cart which is manually propelled by means of a chain and sprocket system. Pivotal movement of the driving sprocket and attached hand wheel about a vertical axis effects steering of the cart. The labor necessary to propel the cart is prodigious and renders the cart generally unacceptable to the workmen. Moreover, the working platform of the cart is not vertically adjustable, which renders the cart suitable only for overhead work within a predetermined height range.

U.S. Pat. No. 3,429,398, illustrates a manually propelled and steerable scaffolding cart which incorporates a vertically positionable platform. The steering wheel, but not the manually operated drive apparatus, is vertically positionable. Accordingly, operation of the manual drive apparatus is extremely awkward, depending upon the respective height of the platform and the workman's physical size.

U.S. Pat. No. 3,232,375, is directed to an electrically powered scaffolding cart wherein one set of wheels are attached to an electric motor and the second set of wheels are steerable through pivotal movement of a yoke. Neither the power actuating mechanism nor the steering mechanism is vertically adjustable commensurate with vertical positioning of the platform for the operator. U.S. Pat. No. 3,256,954, shows a scaffolding cart having four castering wheels, each of which is located at one corner of the cart; a fifth steerable wheel is propelled by an electric motor. U.S. Pat. No. 3,930,548, describes a scaffolding cart having two electrically driven wheels. Steering of the cart is effected by selective energization of one or both of the electrically driven wheels. Further United States patents directed to scaffolding carts and platforms include U.S. Pat. Nos. 751,359, 921,431, 1,727,671, 2,299,323, 2,932,368 and 3,509,966.

While all of the above described prior art scaffolding carts provide an overhead workman with a movable raiseable work platform, certain deficiencies are contained within each of these devices. Where such deficiencies require a helper for the workman in manipulating the cart, the cost of the work being performed is increased not only by the helper's monetary compensation but also by the loss of productive time of the workman while he manipulates the cart as necessary. For those carts wherein the workman himself is fully capable of manipulating the platform to position or adjust it as necessary in order for the workman to practice his profession, the workman's productivity is decreased in direct proportion to the amount of time spent manipulating or adjusting the cart. It is therefore apparent that unless the scaffolding cart is specifically designed not only to provide vertical and horizontal flexibility, but also to minimize the time necessary to horizontally position or vertically adjust the cart platform, the design of the scaffolding cart has not been optimized.

Assuming that there existed no cost restrictions in developing a scaffolding cart, a very elaborate cart could be produced which performed all necessary functions at the mere touch of a switch. However, such a cart is not a practical solution to the problem in that the cost of such a cart must necessarily be calculated in the charges for the work being performed and a cart of this type would render the job costs prohibitive. Accordingly, a balance must be achieved between the cost of the scaffolding cart and the degree of operational convenience to the workman.

It is therefore a primary object of the present invention to provide an inexpensive power driven steerable cart having a vertically positionable work platform.

Another object of the present invention is to provide a scaffolding cart with power and steering controls vertically positionable commensurate with a vertically positionable work platform.

Still another object of the present invention is to provide an easily and rapidly vertically adjustable work platform for a scaffolding cart.

Yet another object of the present invention is to provide an inexpensive drive system coupled with an inexpensive vertically positionable steering mechanism.

A further object of the present invention is to provide vertically positionable guard rails which are positionable commensurate with vertical adjustment of the work platform.

A yet further object of the present invention is to provide a single steerable power driven wheel for a four wheeled scaffolding cart.

A still further object of the present invention is to provide a scaffolding cart transportable from room to room within dwellings as well as within buildings having ceilings and doorways of greater height.

These and other objects of the present invention will become apparent to those skilled in the art as the description thereof proceeds.

The present invention may be described with greater specificity and clarity with reference to the following drawings, in which.

Figure 1:
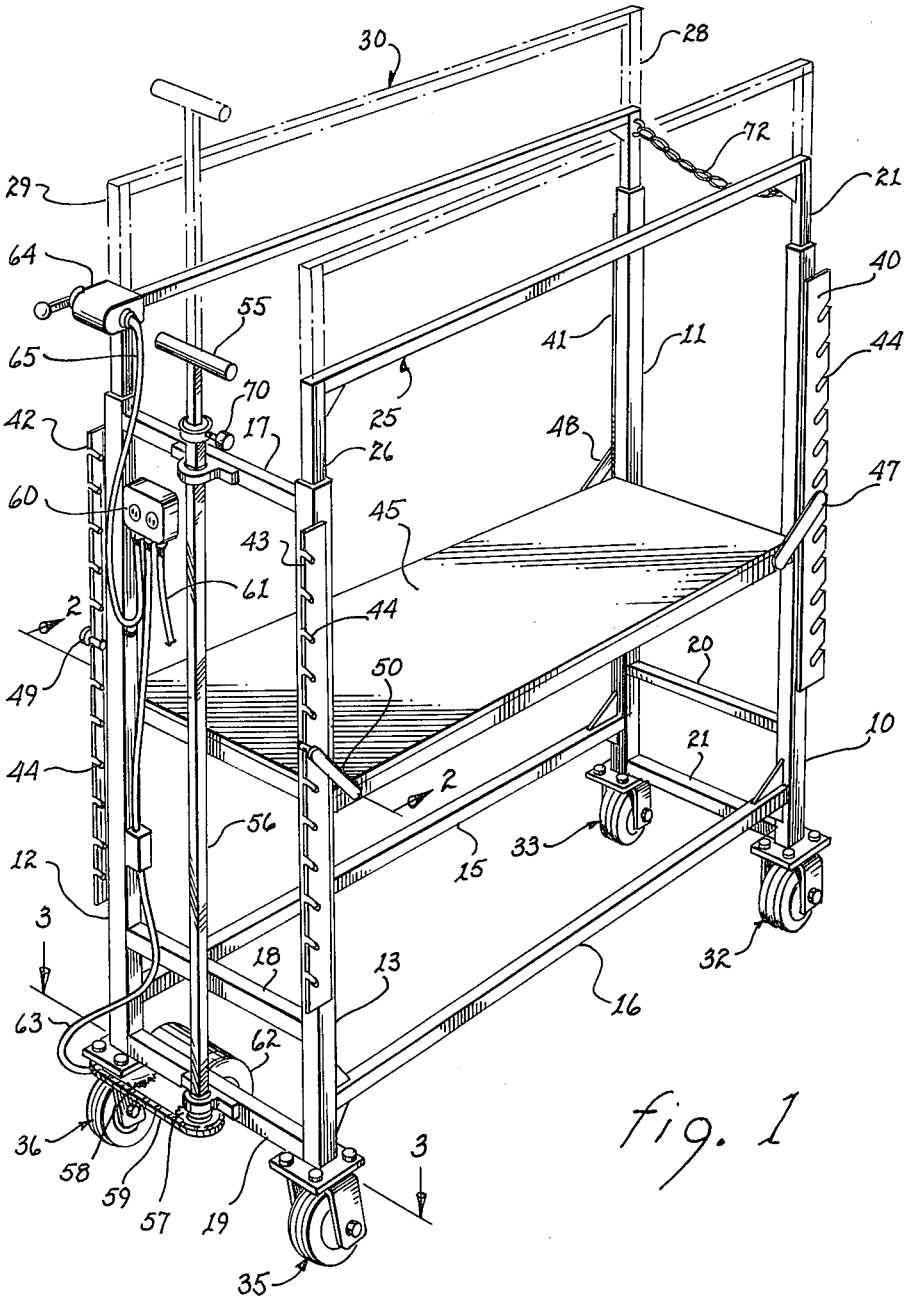
FIG. 1 is a perspective view of the scaffolding cart.

A scaffolding cart incorporating the present invention is illustrated in FIG. 1. The scaffolding cart is developed from four vertical posts 10, 11, 12 and 13 connected to one another through longitudinal cross members 15 and 16 and lateral cross members 17, 18, 19, 20 and 21. To provide additional rigidity, handrail 25 is formed in an inverted U-shape with legs 26 and 27 being telescopingly inserted into the tops of posts 10 and 13. Legs 28 and 29 of a similarly shaped handrail 30 are telescopingly inserted into the tops of posts 11 and 12. The handrails are locked into their vertical position by removable pin means, locking collars or the like.

Supports 40, 41, 42 and 43, each having upwardly opening slated slots 44 therein are attached to posts 10, 11, 12 and 13, respectively. A platform 45 is suspended from each of supports 40, 41, 42 and 43 by pivoting hangers 47, 48, 49 and 50 engaging one of the slots in each support.

Steering of the cart is effected by a T-handle 55 in slidable non-rotatable engagement with steering rod 56. A sprocket 57 is attached to steering rod 56 and drives a further sprocket 58 through chain 59. Sprocket 58 is affixed to wheel assembly 36 whereby rotation of T-handle 55 produces commensurate rotation of wheel assembly 36. An electrical junction box 60 is connected to an external source of electrical power through cord 61; the latter being preferably attached to the scaffolding cart by a coil spring to accommodate tension forces applied to the power cord which might otherwise disconnect the power cord from the scaffolding cart. The junction box supplies power to electric motor 62 through an electrical conductor 63. The power flow through electrical conductor 63 and hence the speed and direction of electric motor 62 is regulated by a manually operated control 64 through a further power cord 65. The junction box also serves as a source of electrical power for any tools employed by the workman while on the scaffolding cart.

Extension and retraction of T-handle 55 is controlled and maintained by means of a manually operated thumb screw 70. Thereby, the T-handle may be raised or lowered commensurate with vertical repositioning of platform 45. Control 64 is attached to leg 29 of handrail 30 whereby the control is raised or lowered commensurate with raising or lowering of the handrail; the latter being repositioned as necessary commensurate with the vertical position of platform 45.

From the above description, it will become apparent that a workman standing upon platform 45 has at his disposal complete control over movement of the scaffolding cart with respect to both speed and direction. Furthermore, platform 45 may be readily raised or lowered by the worker and without the aid of a helper by simply repositioning hangers 47, 48, 49 and 50 into higher or lower slots. Similarly, handrails 25 and 30 may be raised or lowered to insure against the workman falling off of the platform while performing his work.

Normally, access to platform 45 is in between posts 10 and 11 as no impeding cross member is mounted therebetween above the platform. After the workman is on board platform 45 he may secure safety chain 72 across the tops of posts 10 and 11. A ladder, attachable to the platform to simplify ingress and egress, may be incorporated.

Figure 2:
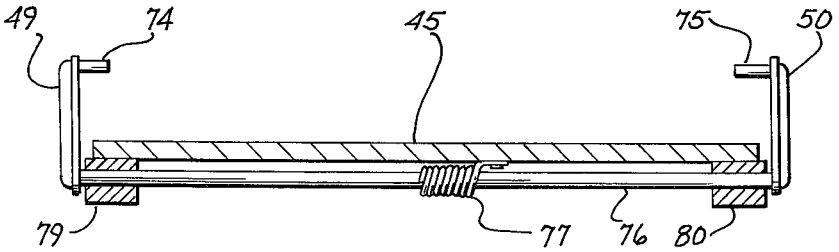
FIG. 2 is a cross-sectional view of the platform retaining mechanism taken along lines 2—2, as shown in FIG. 1.

Referring now to the remaining figures, the constructional features of the various elements of particular importance will be described. FIG. 2 illustrates the hanger assembly attached to each end of platform 45. Hangers 49 and 50 include inwardly extending studs 74 and 75 which are diametrically dimensioned to slidably engage one of the slots within supports 42 and 43, respectively. By interconnecting hangers 49 and 50 with a shaft 76, the workman may grasp either of the hangers to effect pivotal movement of both of them to engage or disengage the studs from their respective slot. Hence, the workman need not waste time in individually engaging and disengaging each corner of the platform. Shaft 76 is rotatably biased by a coil spring 77 to urge rotation of the hangers toward their respective supports. Thereby, the possibility of the studs becoming inadvertantly disengaged from their respective slots within the supports is unlikely; moreover, by simply lifting one end of platform 45, the studs will automtically slide upwardly along their slots until disengagement finally occurs. Further upward movement of the platform will result in a stepped temporary engagement of each succeeding slot opening. Once the end of the platform has been raised to a sufficient degree, it may be lowered to permit the studs of the hangers to slide downwardly into the next adjacent slot. To lower platform 45, the workman need only pivot one of the handles outwardly while slightly raising the respective end of the platform. After lowering the respective end of the platform, and upon reaching the desired level, the grasped handle is released to allow the studs to engage and slide into the next adjacent slots. Pivotal movement of shaft 76 is accommodated by means of cylindrical bearing surfaces disposed within frame members 79 and 80 of platform 45 or by pillow blocks.

Figure 3:
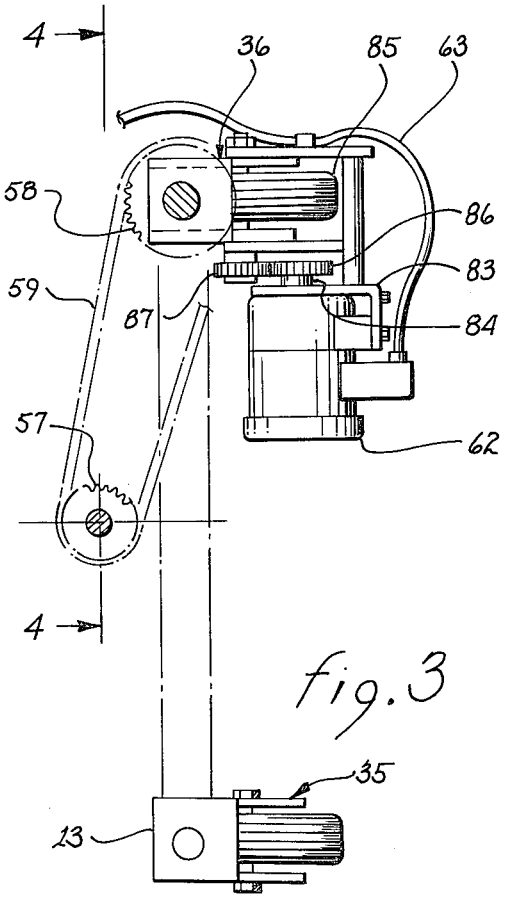
FIG. 3 is a top view of the drive and steering mechanism, taken along lines 3—3, as shown in FIG. 1.

FIG. 3 illustrates the power drive means for wheel assembly 36 and a portion of the steering mechanism for the wheel assembly. A frame 83 is securely attached to and extends from elements of wheel assembly 36 for supporting electric motor 62. Output shaft 84 of the electric motor is connected to the hub of wheel 85 through reduction gears 86 and 87. On energization of electric motor 62 by the application of electrical power through electrical conductor 63, wheel 85 is caused to rotate and propel the scaffolding cart.

The steering mechanism for the scaffolding cart will be described with particular reference to FIGS. 3 and 4. Wheel assembly 36 includes an upwardly extending stud 90 pivotally mounted within and retained by a bearing 91 internally secured to a lower end of post 12. Thereby, wheel assembly 36, including electric motor 62 and supporting frame 83, is pivotable about a vertical axis. On manual rotation of T-handle 55, the rotational movement is translated through steering rod 56 to sprocket 57. Rotation of sprocket 57 results in a commensurate rotation of sprocket 58 by means of meshed chain 59. Sprocket 58 is rigidly attached to wheel assembly 36 whereby rotation of the sprocket produces a commensurate pivotal movement of the wheel assembly. As illustrated in FIG. 3, wheel assembly 35 is a castering wheel pivotally secured to the lower extremity of post 13. By inspection, it becomes apparent that upon pivotable movement of wheel assembly 36 under command of T-handle 55, and assuming the scaffolding cart be traveling forwardly, the wheel of wheel assembly 35 will, through its castering capability, track with wheel assembly 36.

Figure 4:
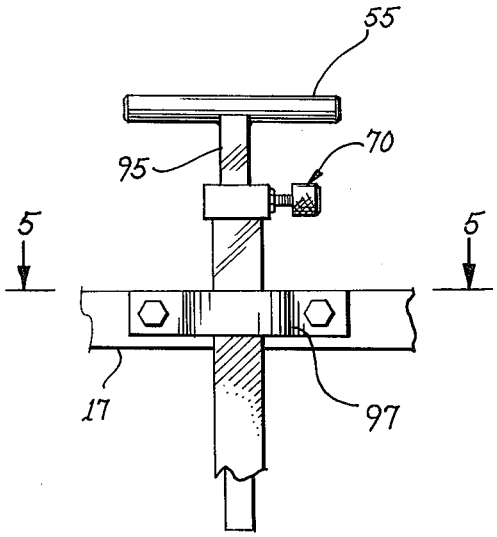
FIG. 4 is a sectional view of the steering and drive mechanism taken along lines 4—4, as shown in FIG. 3
Figure 4:
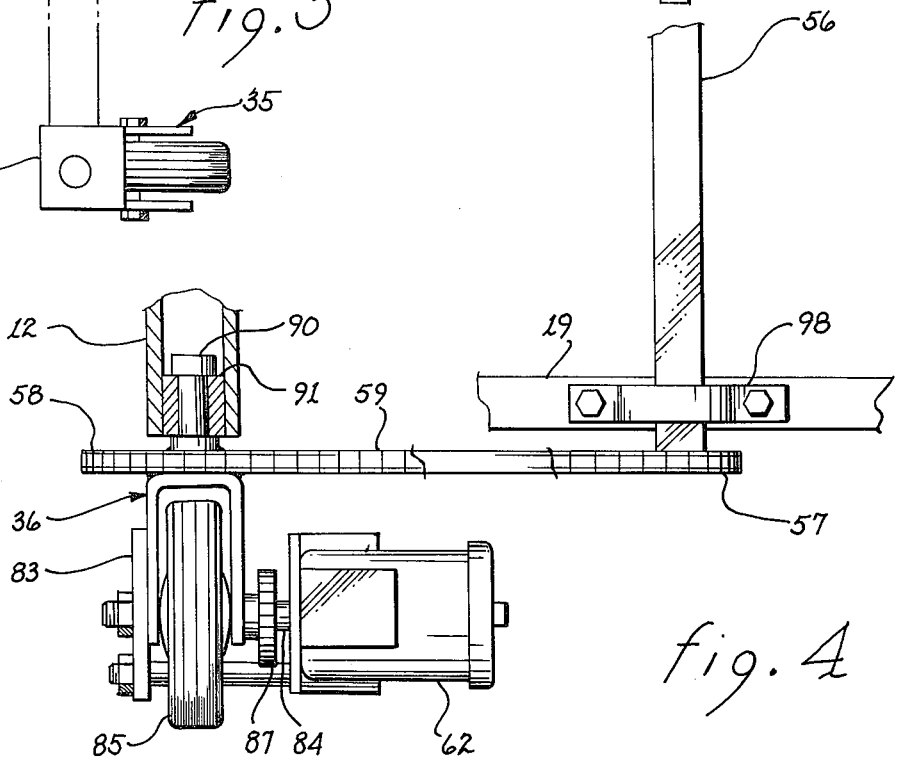
Figure 5:
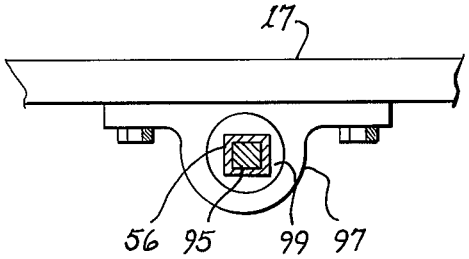
FIG. 5 illustrates a cross-section of the steering rod and support therefor taken along lines 5—5, as shown in FIG. 4.

Referring jointly to FIGS. 1, 4 and 5, the vertical displacement capability of the steering mechanism will be described. T-handle 55 is attached to a length of square tubing 95. The tubing is slidably matingly disposed within steering rod 56 which is also a length of square tubing. Accordingly, a very simple system has been incorporated which accommodates unrestricted vertical movement of T-handle 55 while negating independent rotational movement between tubing 95 and steering rod 56. Once T-handle 55 has been extended or retracted to a comfortable height for the workman, its position is temporarily locked by means of manually operated thumb screw 70. Steering rod 56 is attached to and supported upon lateral cross members 17 and 19 by pillow blocks 97 and 98. Each of these pillow blocks includes a cylindrical bearing 99 rotatably supported within and retained by the respective pillow block. The bearing is apertured to snugly receive steering rod 56 and the enveloped section of tubing 95.

Although not illustrated in any of the figures, further simplification of the steering mechanism may be effected by mounting tubing 95 and the enveloping steering rod 56 within the confines of post 12. In this configuration, the steering rod would be non-rotatably connected to stud 90. Thereby, a direct drive from T-handle 55 to wheel assembly 36 could be effected. Such a modification is particularly suitable for the scaffolding cart described above in that no elements are attached to post 12 which require penetration of the post. However, some modification might be necessary to handrail 30 in order to permit tubing 95 and T-handle 55 to extend through leg 29 of the handrail. Conceivably, this problem could be solved by selecting the cross-sectional dimensions of the leg to be sufficient not to restrict rotation of tubing 95.

In summary, the scaffolding cart described above employs off the shelf materials which are readily welded or otherwise attached to one another and does not require specially machined parts. The necessary assembly during manufacuture is relatively straightforward and performable by those normally skilled in metal work and having an understanding of the fundamental requirements of the scaffolding cart. Accordingly, the costs of manufacture are exceedingly low. Because of the robustness of the metallic elements employed and the simplicity of the component parts, periodic down time is de minimis and the failure rate is very low.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A powered steerable scaffolding cart having a vertically positionable platform and handrails for transporting a workman, said scaffolding cart comprising in combination:

a. a framework including a vertical post disposed at each corner of said framework and cross members extending intermediate said vertical posts;

b. a wheel assembly secured in proximity to each corner of said framework for supporting said framework;

c. power means attached to one of said wheel assemblies for propelling said scaffolding cart;

d. pivot means attached to said one wheel assembly for pivoting said one wheel assembly;

e. steering means secured to said framework for pivoting said one wheel assembly with respect to said cart, said steering means being fixedly secured to said framework at a point laterally displaced from the vertical post in proximity to said one wheel assembly, said steering means including:

i. a handle accessible to the workman;

ii. telescoping tubing elements for raising and lowering said handle commensurate with vertical repositioning of said platform; and iii. chain and sprocket means interconnecting said tubing elements and said one wheel assembly for pivoting said one wheel assembly on commensurate pivotal movement of said handle;

f. control means for regulating the operation of said power means, said control means including positionable support means for raising and lowering said control means commensurate with vertical repositioning of said platform; and g. attachment means for supporting said platform from said framework, said attachment means comprising:

i. a plurality of slanted slots disposed in said vertical posts; and ii. a plurality of hangers pivotally attached to said platform, each said hanger including a stud for engaging one of said slots;

whereby, said platform is readily vertically positionable by reengaging said hangers with different ones of said slots and the speed and direction of travel of said scaffolding cart is under the control of the workman supported upon said platform regardless of the vertical position of said platform.

2. The scaffolding cart as set forth in claim 1 wherein another of said wheel assemblies is a castering wheel for tracking with said one wheel assembly.

3. The scaffolding cart as set forth in claim 2 wherein said steering means comprises a T-handle, a first length of square tubing extending from said T-handle, a second length of square tubing for telescopingly receiving said first tubing, lock means for vertically extending and contracting said first tubing with respect to said second tubing, bearing means mounted upon said cross members for supporting said second tubing, a first sprocket attached to the lower end of said second tubing, a second sprocket attached to said one wheel assembly and a chain interconnecting said first and said second sprockets, whereby the vertical position of said T-handle is settable commensurate with the vertical position of said platform and rotation of said T-handle produces rotation of said one wheel assembly.

4. The scaffolding cart as set forth in claim 3 wherein said power means includes a frame extending from said one wheel assembly and an electric motor attached to said frame.

5. The scaffolding cart as set forth in claim 4 wherein said hangers comprises pairs of hangers pivotally attached to opposing sides of said platform, a shaft interconnecting each hanger of said pair of hangers and spring means interconnecting said shaft and said platform for biasing said studs of the attached pair of hangers into said slots.

6. The scaffolding cart as set forth in claim 5 wherein said attachment means includes a support attached to each said vertical post and said plurality of slanted slots comprise a plurality of stacked slots developed within each said support.

7. The scaffolding cart as set forth in claim 6 wherein said slots are stacked at intervals of 3 inches.

8. The scaffolding cart as set forth in claim 7 where said handrails are vertically positionable commensurate with vertical repositioning of said platform.

9. The scaffolding cart as set forth in claim 8 where each said handrail comprises an inverted U-shaped element having a pair of legs, each of said legs being telescopingly positionable within one of said vertical posts.

10. The scaffolding cart as set forth in claim 1 wherein said power means includes a frame extending from said one wheel assembly and an electric motor attached to said frame.

11. The scaffolding cart as set forth in claim 1 wherein said hangers comprise pairs of hangers pivotally attached to opposing sides of said platform, a shaft interconnecting each hanger of said pair of hangers and spring means interconnecting said shaft and said platform for biasing said studs of the attached pair of hangers into said slots.

12. The scaffolding cart as set forth in claim 11 wherein said attachment means includes a support attached to each said vertical post and said plurality of slanted slots comprise a plurality of stacked slots within each said support.

13. The scaffolding cart as set forth in claim 12 wherein said slots are stacked at intervals of 3 inches.

14. The scaffolding cart as set forth in claim 1 wherein said handrails are vertically positionable commensurate with vertical repositioning of said platform.

15. The scaffolding cart as set forth in claim 14 wherein each said handrail comprises an inverted U-shaped element having a pair of legs, each of said legs being telescopingly positionable within one of said vertical posts.

* * * * *